US009847167B2

(12) United States Patent
Ballard et al.

(10) Patent No.: US 9,847,167 B2
(45) Date of Patent: Dec. 19, 2017

(54) ENHANCED TRACK RESISTANT DOME STRUCTURE FOR DRY-TYPE CAST COIL TRANSFORMER

(71) Applicants: ABB TECHNOLOGY AG, Zurich (CH); Robert C. Ballard, Wytheville, VA (US)

(72) Inventors: Robert C. Ballard, Wytheville, VA (US); Ryan Christian Tyler Alkire, Christiansburg, VA (US); Brian J. Akers, Ivanhoe, VA (US); Thomas A. Gburek, Lewisville, NC (US); Pascal Schutt, Borchen (DE)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 14/902,355

(22) PCT Filed: Jul. 18, 2013

(86) PCT No.: PCT/US2013/051007
§ 371 (c)(1),
(2) Date: Dec. 31, 2015

(87) PCT Pub. No.: WO2015/009301
PCT Pub. Date: Jan. 22, 2015

(65) Prior Publication Data

US 2016/0155563 A1 Jun. 2, 2016

(51) Int. Cl.

| | |
|---|---|
| ***H01F 21/12*** | (2006.01) |
| ***H01F 27/30*** | (2006.01) |
| ***H01F 27/32*** | (2006.01) |
| ***H01F 41/12*** | (2006.01) |
| ***H01F 27/29*** | (2006.01) |
| ***H01F 41/10*** | (2006.01) |

(52) U.S. Cl.
CPC ..... *H01F 27/327* (2013.01); *H01F 27/29* (2013.01); *H01F 41/10* (2013.01); *H01F 41/127* (2013.01)

(58) Field of Classification Search
CPC ..... H01F 27/327; H01F 27/29; H01F 27/32; H01F 27/323; H01F 41/127; H01F 41/10; H01F 41/12; H01F 2027/328
USPC ..... 336/192, 221, 205, 137–150; 264/272.13; 323/340; 200/11 TC
See application file for complete search history.

(56) References Cited

U.S. PATENT DOCUMENTS 4,459,575 A * 7/1984 Geissler ..... H01F 27/08 336/192

FOREIGN PATENT DOCUMENTS

| | | | |
|---|---|---|---|
| CN | 1516206 | A | 7/2004 |
| CN | 102903491 | A | 1/2013 |
| EP | 2518739 | A1 * | 10/2012 |

(Continued)

OTHER PUBLICATIONS

International Search Report and Written Opinion in PCT/US13/51007 dated Apr. 10, 2014.

(Continued)

*Primary Examiner* — Mangtin Lian
(74) *Attorney, Agent, or Firm* — Manelli Selter PLLC; Edward Stemberger

(57) ABSTRACT

A dry type cast coil transformer (28) includes a hollow body (29), a dome structure (26) extending from the body, and undulation structure (30), defining at least a portion of an outer surface of the dome structure, constructed and arranged to increase an electrical track path in the dome structure.

11 Claims, 6 Drawing Sheets

(56) References Cited

FOREIGN PATENT DOCUMENTS

| | | | |
|---|---|---|---|
| GB | 2220945 | A | 1/1990 |
| JP | S55143017 | A | 11/1980 |
| JP | S56142616 | A | 11/1981 |
| JP | S6163006 | A | 4/1986 |

OTHER PUBLICATIONS

Office Action in CN 2013800782731 and English Translation thereof dated Jan. 23, 2017.
Search Report in CN 2013800782731 dated Jan. 12, 2017.

* cited by examiner

ENHANCED TRACK RESISTANT DOME STRUCTURE FOR DRY-TYPE CAST COIL TRANSFORMER

FIELD

The invention relates to dry type transformers and, more particularly, to a dome area of the transformer that has features to increase the track path between taps.

BACKGROUND

A dry type transformer uses a complex system of air and solid insulation to prevent energized parts from contacting each other or ground. Many dry type cast coil transformers, such as disclosed in U.S. Pat. No. 6,445,269, are filled with epoxy in a horizontal orientation which makes a flat top surface called a 'dome'. The dome area of a transformer houses the start and finish taps as well as voltage adjustment taps that have a large voltage gradient. This voltage gradient can cause solid insulations to electrically track due to material properties and distance. This dome area is where the customer makes connections to the transformer and where the voltage input/output of the transformer is adjusted to account for the incoming utility voltage. One of the main considerations is the track path from an energized part to another conductive part at a different potential. The flat top surface of the conventional dome area can lead to medium voltage tracking between energized parts when exposed to harsh environments such as off shore platforms, refineries, wind turbines, pulp and paper mills, etc.

Conventionally, increasing the track path requires the transformer coil to be cast with the voltage adjustment taps oriented downwardly or vertically to create bushings. Such a transformer coil has two common disadvantages. First, more epoxy is used than actually needed to fulfill the requirements of the coil. Secondly, the regions of the unnecessary epoxy are prone to the risk of cracks because of the large thickness of epoxy.

Thus, there is a need to provide a dome structure for a dry type cast coil transformer with undulation structure that allows a greater track path between taps, allows a casting process where the voltage taps face upwardly, and uses less epoxy than conventional dome areas.

SUMMARY

An object of the invention is to fulfill the need referred to above. In accordance with the principles of the present invention, this objective is obtained by a dry type cast coil transformer that includes a hollow body, a dome structure extending from the body, and undulation structure, defining at least a portion of an outer surface of the dome structure, constructed and arranged to increase an electrical track path in the dome structure.

In accordance with another aspect of the disclosed embodiment, a method of molding a dry type cast coil transformer having a dome structure is provided. The method provides a mold having a dome mold structure. The dome mold structure includes features for molding at least two tap connection bases from which a respective tap connection extends, and undulation forming structure adjacent to the bases for molding undulation structure. Windings are placed in the mold. The windings are coupled to the tap connections. The mold is oriented so that the tap connections are arranged upwardly. Epoxy is poured into the mold and permitted to cure. The mold is removed to obtain the cast coil transformer having the undulation structure adjacent to the tap connection bases.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF EXEMPLARY EMBODIMENTS

Figure 1:
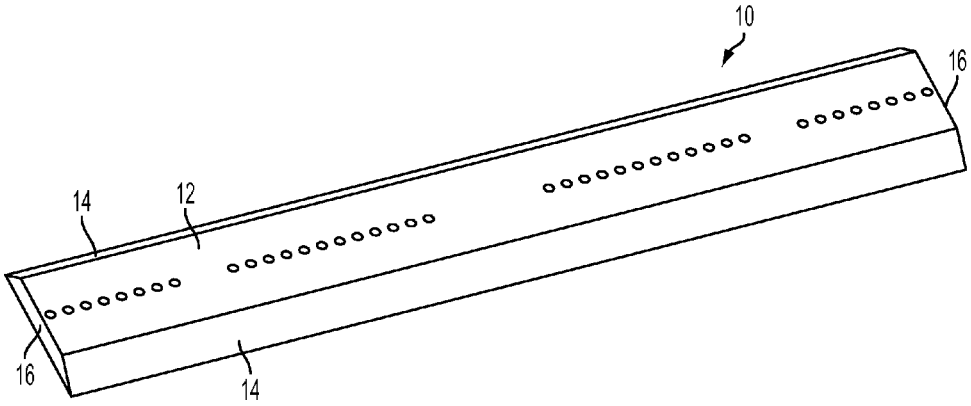
FIG. 1 is a top view of a mold for forming an outer surface of a dome structure of a dry type cast coil transformer, providing in accordance with an embodiment.
Figure 2:
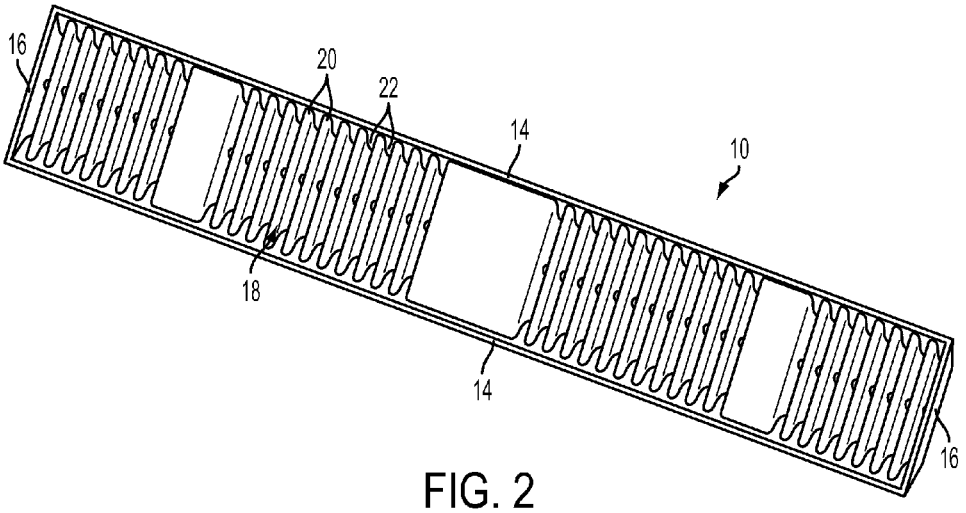
FIG. 2 is a view of the underside of the mold of FIG. 1 showing undulation forming structure therein.

With reference to FIGS. 1 and 2, a mold portion 10 is shown, for molding a dome structure of a dry type cast coil transformer 28 (FIG. 3), in accordance with and embodiment. The mold portion 10 includes a base 12, a pair of opposing side walls 14 and a pair of opposing end walls 16. As shown in FIG. 2 undulation forming structure, generally indicated at 18, extends from the underside of the base 12. The undulation forming structure 18 includes a plurality of alternating, continuously joined, peaks 20 and valleys 22. In the embodiment, the peaks 20 define rounded fins and the valleys 22 are also rounded.

Figure 3:
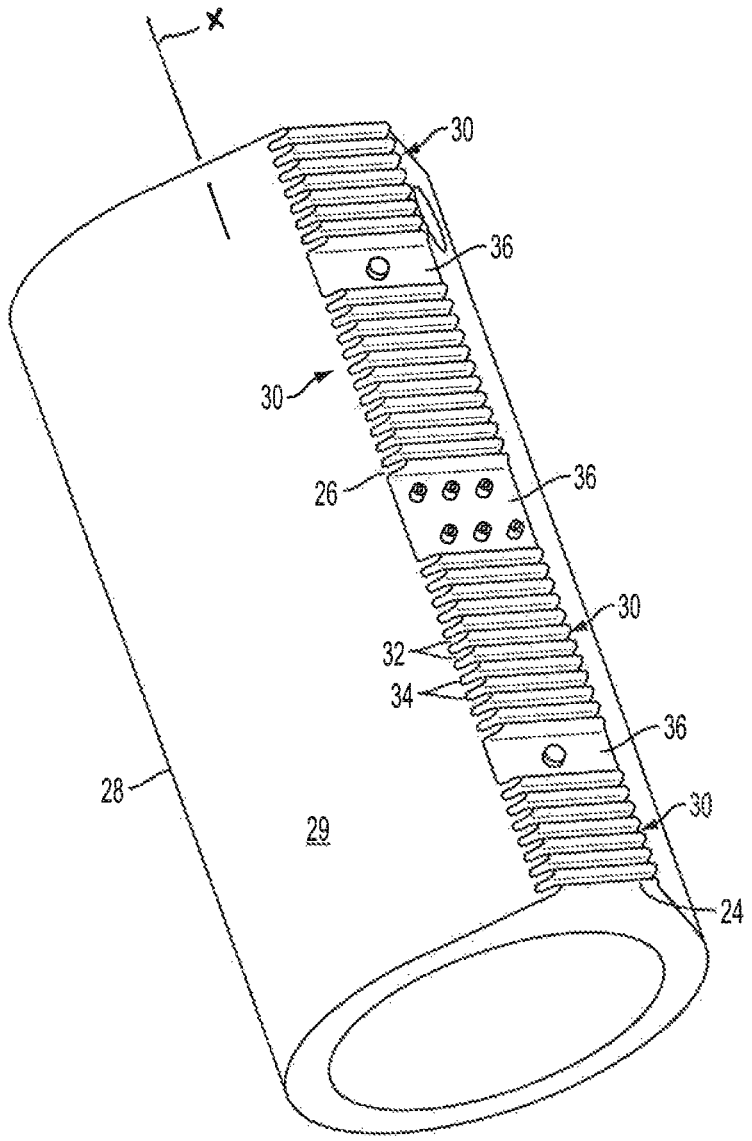
FIG. 3 shows the top surface of a dome structure of a dry type case coil transformer having undulation structure resulting from the mold of FIG. 2.

To form a cast coil transformer, a winding (not shown) with suitable is insulating material is placed in a mold (see, e.g., mold 68' of FIG. 6) that includes the mold portion 10. Liquid epoxy is then poured into the mold and cured. With reference to FIG. 3 an outer surface 24, of a dome structure 26 of a dry type cast coil transformer 28, is shown that results from using the mold portion 10 of FIG. 2. The body 29 of the coil transformer 28 is of conventional, hollow, generally cylindrically shaped configuration, with the dome structure extending from the body 29. The winding is cast inside the body 29. The outer surface 24 includes undulation structure, generally indicted at 30, that includes a plurality of alternating, continuously joined, peaks 32 and valleys 34. As shown in FIG. 3, each peak 32 is spaced from an adjacent peak 32 in a direction parallel to a longitudinal axis X of the body 29. In the embodiment, the peaks 32 define rounded fins and the valleys 34 are also rounded. The undulation structure 30 can be separated by tap connection bases 36 that are directly adjacent thereto. The undulation structure 30 increases the effective track path and reduces the chances of dielectric failure.

Figure 4A:
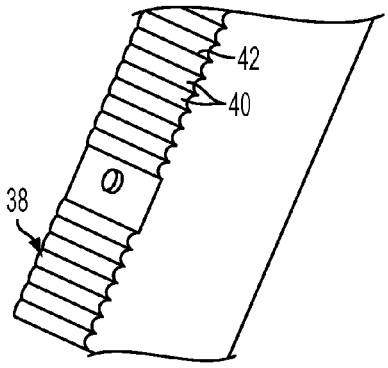
FIG. 4A shows undulation structure having half-moon shape in accordance with another embodiment.
Figure 4B:
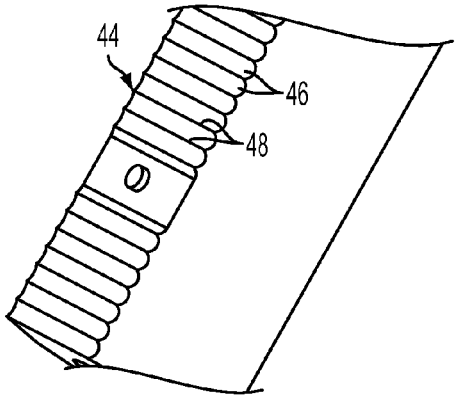
FIG. 4B shows undulation structure having inverse half-moon shape in accordance with another embodiment.
Figure 4C:
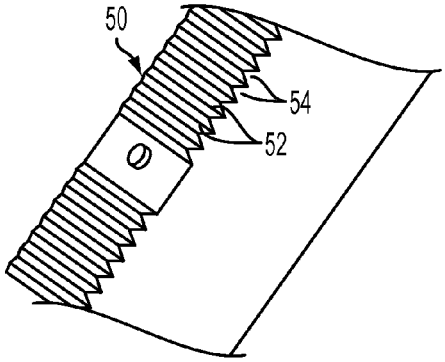
FIG. 4C shows undulation structure having saw-tooth shape in accordance with yet another embodiment.
Figure 4D:
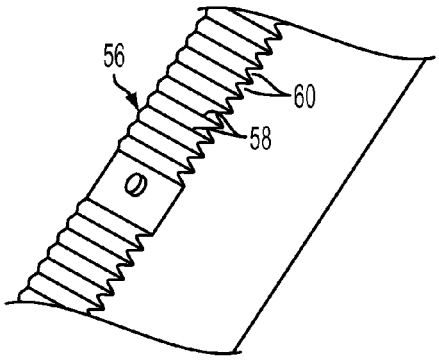
FIG. 4D is shows undulation structure having sine wave shape in accordance with another embodiment.
Figure 4E:
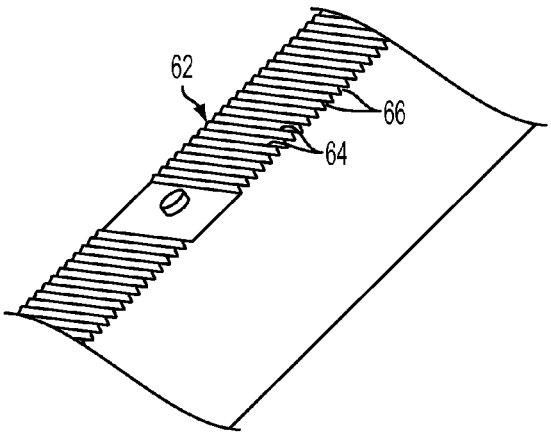
FIG. 4E is shows undulation structure having cosine shape in accordance with still another embodiment.

Alternate contoured geometries for the undulation structure 30 can be used. For example, FIG. 4A shows the undulation structure 38 having half-moon shaped peaks 40 with alternating valleys 42. FIG. 4B shows undulation structure 44 having half-moon shaped valleys with alternating peaks 48. FIG. 4C shows undulation structure 50 of saw-tooth shape having alternating peaks 52 and valleys 54. FIG. 4D is shows undulation structure 56 of sine wave shape having alternating peaks 58 and valleys 60. FIG. 4E is shows undulation structure 62 of cosine wave shape having alternating peaks 64 and valleys 66. Other shapes can be used with any amplitude and period.

The process of adding the undulation structure to the dome structure of the dry type cast coil transformer allows a greater track path to be established while using a horizontal casting method with the voltage taps facing upwardly. Currently, increasing the track path requires the transformer coil to be cast with the voltage adjustment taps down or horizontal to create bushings. The undulation structure also provides an improved cooling surface when transformer is in operation.

To minimize the volume of epoxy and thus reduce the risk of cracks in a cast coil transformer, the epoxy can be removed between the electrically connected sections and then, if desired, any of the undulation structures mentioned above can be applied to the dome structure 26.

Figure 5:
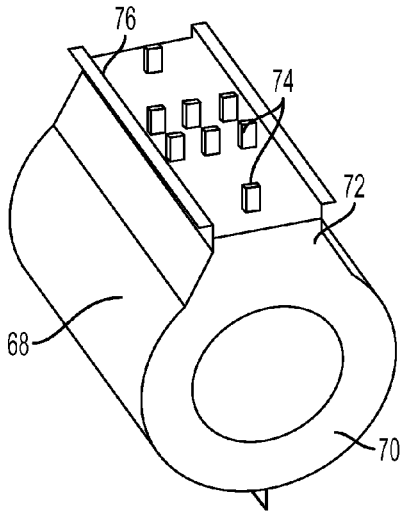
FIG. 5 (PRIOR ART)
FIG. 5 is a perspective view of a conventional mold for a dry type cast coil transformer, with the mold having an open top forming the dome structure.

FIG. 5 shows a conventional mold 68 for molding a conventional cast coil transformer 70 having a dome structure 72 that includes the conductor leads (taps) 74. The shape of the dome structure 72 results from the mold shape that is opened to the top side 76 (related to the casting and curing position) where the epoxy mixture is introduced into the mold 68.

Figure 6:
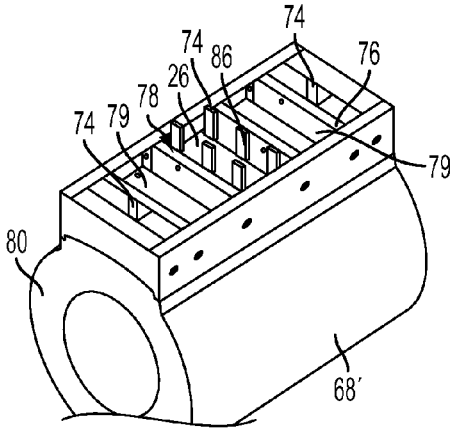
FIG. 6 is a perspective view of mold for a dry type cast coil transformer in accordance with an embodiment, with the mold having additional structure on the top side for forming the dome structure.

With reference to FIG. 6, instead of the mold structure which has an open top, in accordance with an embodiment, the mold 68' includes additional dome mold structure, generally indicated at 78, that limits the entire shape of the dome structure 26 on the top side 76. The dome mold structure 78 ensures that the epoxy 80 can only fill out the necessary volume located around the tap connection bases 86 (FIG. 9) for the taps 74. More particularly, the dome mold structure 78 includes mold features 79 adjacent to the bases 86 that prevent epoxy from accumulating thereby reducing the amount of epoxy adjacent to the bases 86. A special requirement is the possibility of adaption for the whole measurements spectrum of the coil outer diameter, the coils maximum height and the position of the taps but without the creation of a large variety of different dome mold parts.

Figure 7A:
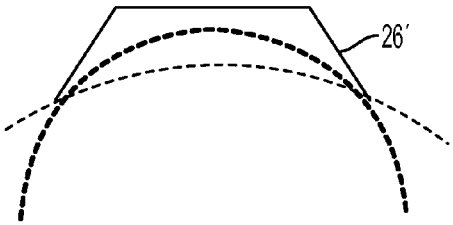
FIG. 7A is a schematic end view of a three-sided dome shape in accordance with an embodiment.
Figure 7B:
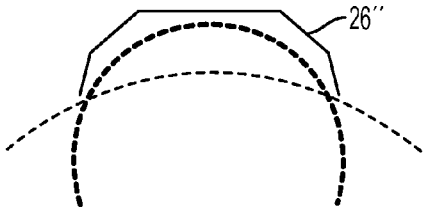
FIG. 7B is a schematic end view of a five-sided dome shape in accordance with an embodiment.
Figure 7C:
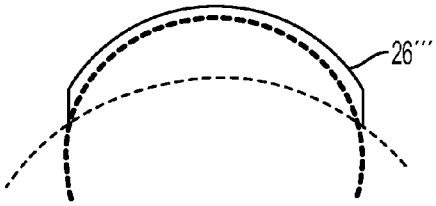
FIG. 7C is a schematic end view of a circle dome shape with an offset in accordance with an embodiment.
Figure 7D:
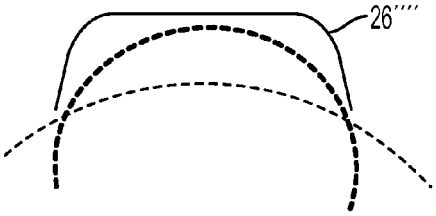
FIG. 7D is a schematic end view of a three-sided dome shape with rounded edges in accordance with an embodiment.

To fulfill the requirement of the independence on the outer diameter of the coil, the dome mold structure 78 possesses a basic shape along the entire coil height (as in the conventional construction) but decreased to a minimum. Generally, the shape of the dome structure 26 (without considering the taps 74) should be part of a circle, similar to imitate the shape of the coil, and should minimize the epoxy volume. Some possible shapes of the dome structure 26 are shown in FIGS. 7A-7D. For example, FIG. 7A shows the dome structure 26' having a three-sided shape, FIG. 7B shows the dome structure 26" having a five-sided shape, FIG. 7C shows the dome structure 26''' having circle shape with an offset, and FIG. 7D shows the dome structure 26'''' having a three-sided shape with rounded edges. Other shapes are possible that reduce the volume of the dome structure.

Figure 8A:
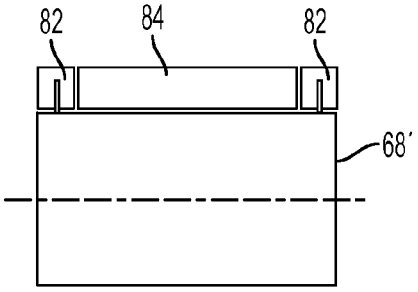
FIG. 8A is a schematic side view showing two end-tap molds and a spacer for an embodiment of a dry type cast coil transformer.
Figure 8B:
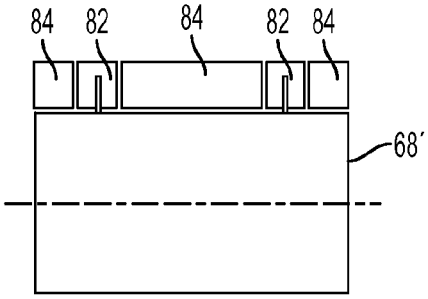
FIG. 8B is a schematic side view showing two end-tap molds and three spacers for an embodiment of a dry type cast coil transformer.
Figure 8C:
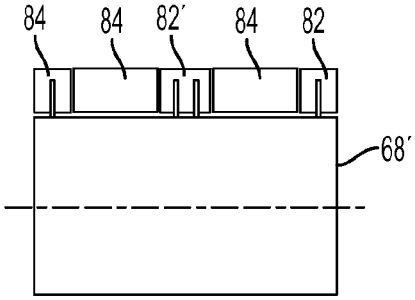
FIG. 8C is a schematic side view showing two-end tap molds, one center-tap mold and two spacers for an embodiment of a dry type cast coil transformer.
Figure 8D:
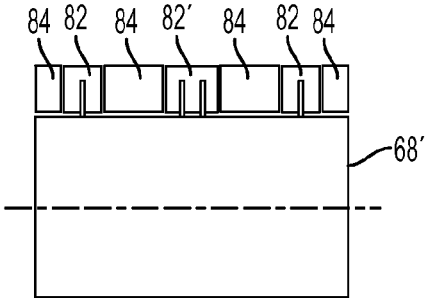
FIG. 8D is a schematic side view showing two-end tap molds, one center tap mold and four spacers for an embodiment of a dry type cast coil transformer.

The choice of the best shape of the dome structure 26 depends on the spectrum of the outer diameters and also the fabrication method may be a consideration. Furthermore, to fulfill the requirement of different heights, tap positions and their amount, the dome mold structure 78 needs to be parted in several sectors along the height. The amount of sectors depends on the amount of taps 74 and/or tap regions (if several taps are located very close it makes sense to combine their bases to one) and their positions (if the end taps are not very close to the face side of the coil a spacer between the end tap mold and the face sides is necessary). The general transformer configuration consists of two end taps and an area of several taps in the center of the coil. Several transformer configurations are shown in FIGS. 8A-8D. For example, FIG. 8A shows two end-tap molds 82 and a spacer 84, FIG. 8B shows two end-tap molds 82 and three spacers 84, FIG. 8C shows two-end tap molds 82, one center-tap mold 82', and two spacers 84, and FIG. 8D shows two-end tap molds 82, one center tap mold 82', and four spacers 84.

The tap molds 82, 82' are meant to be the same for every coil and shall be used many times. The spacers 84 just carry the shape of the dome structure 26 and may include the undulation forming structure 18 of FIG. 2. The spacers 84 can have different lengths depending on the position and amount of taps and the total length of the coil. The spacers 84 could be extruded aluminum profiles with shape of the dome structure 26 that allows a very easy and fast fabrication of the spacers. All fabricated parts can be stored and used again in later cases. To minimize a high variety of spacers 84, standardized coil length and tap position could be defined.

Figure 9:
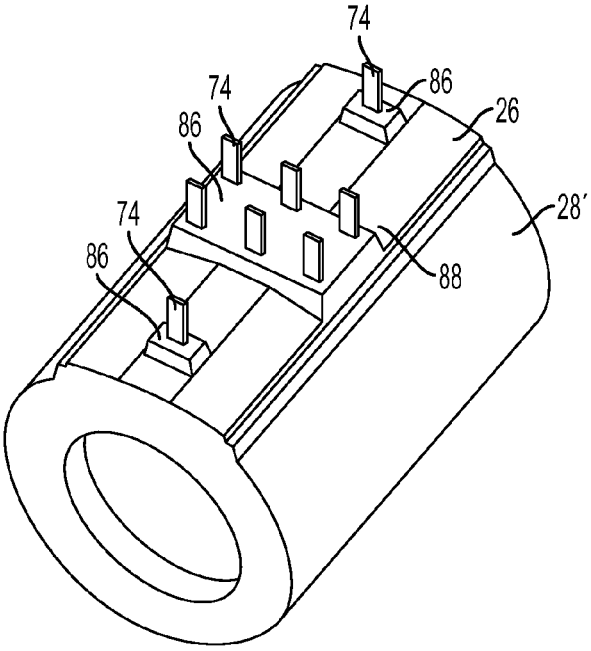
FIG. 9 is a top perspective view of a dome structure of a dry type cast coil transformer with tap connection bases resulting from the mold of FIG. 6.

FIG. 9 shows a cast coil transformer 28' having a dome structure 26 (without undulation structure) that results from the mold 68' of FIG. 6. In the embodiment, the dome structure 26 has a minimized volume along the whole coil height and has three tap connection bases 86 for the taps 74 which also have a minimum of volume. The tap connection bases 86 are raised with respect to an adjacent upper surface 88 of the dome structure, thus reducing the volume of the dome structure 26 due to the material omitted adjacent to the bases 86.

Figure 10:
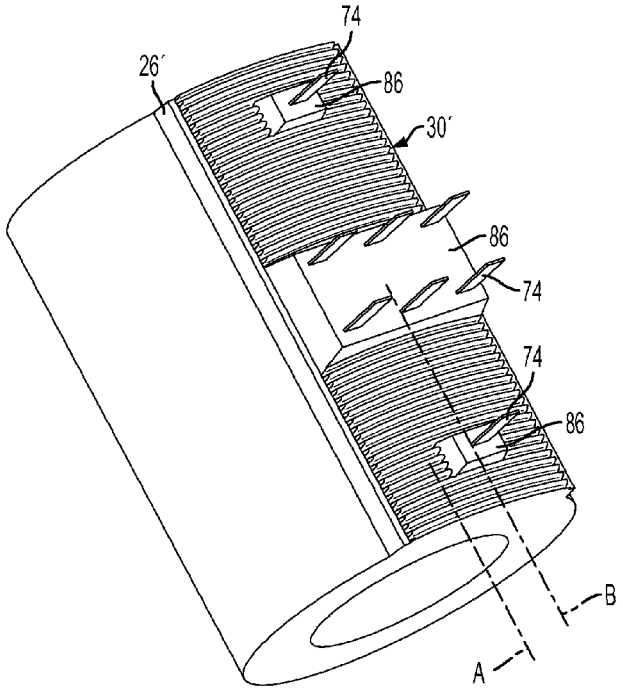
FIG. 10 is a top perspective view of a dome structure of a dry type cast coil transformer with undulation structure adjacent to raised tap connection bases in accordance with and embodiment.

In the embodiment of FIG. 10, the dome structure 26' includes the undulation structure 30' that is on a plane A that is below a plane B of the tap connection bases 86', 86" so that the tap connection bases are raised with respect to the undulation structure. As disclosed above, the undulation structure 30' increases the effective track path and reduces the chances of dielectric failure. The volume of epoxy cast is also reduced due to the recessed undulation structure 30'.

Figure 11:
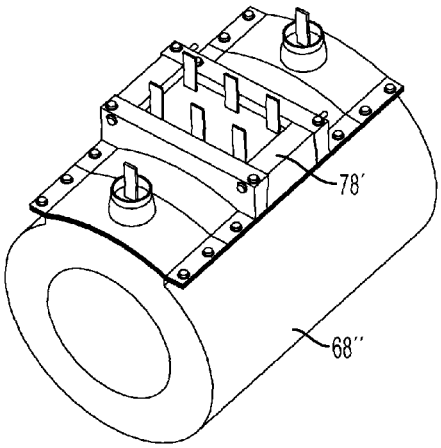
FIG. 11 is a perspective view of a mold for another shape of the dome structure of a dry type cast coil transformer.
Figure 12:
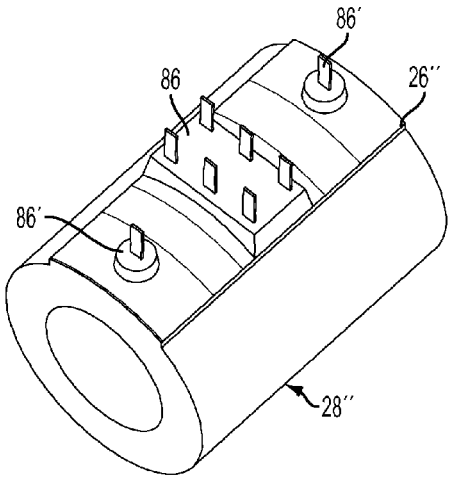
FIG. 12 is a perspective view of a dry type cast coil transformer with a dome structure formed by the mold of FIG. 11.

The tap connection bases 86 can have different shapes as well. The configuration of the bases 86 basically depends on the best way to fabricate the bases. Some configuration of the bases can include a cone shape (especially for the end taps), a pyramid shape, rectangular, square, oval conic shape or other shapes. FIG. 11 shows a transformer mold 68' having a dome mold structure 78" in accordance with another embodiment to produce end located, generally oval-shaped bases 86' and a central, generally rectangular shaped base 86 of the dome structure 26" of a cast coil transformer 28" of FIG. 12.

The change of shape of the dome structure 26 down to a minimum volume and the addition epoxy tap connection bases 86 just surrounding the taps 74 reduces the volume and thus the cost of the coil transformer. Furthermore, the minimized thickness of the dome structure 26 reduces the risk of cracks which may occur after curing.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A dry type cast coil transformer comprising:

a hollow body having a longitudinal axis, a dome structure extending from the body, undulation structure, defining at least a portion of an outer surface of the dome structure, constructed and arranged to increase an electrical track path in the dome structure, and at least one tap connection base separate from, disposed in spaced relation with, and adjacent to the undulation structure, wherein the undulation structure comprises a plurality of alternating, continuously joined, peaks and valleys with the each peak being spaced from an adjacent peak in a direction parallel to the longitudinal axis.

2. The transformer of claim 1, wherein the peaks or the valleys are of half-moon shape.

3. The transformer of claim 1, wherein the undulation structure is of saw-tooth configuration.

4. The transformer of claim 1, wherein the undulation structure is of sine wave configuration.

5. The transformer of claim 1, wherein the undulation structure is of cosine wave configuration.

6. The transformer of claim 1, at least one of the peaks or valleys is rounded.

7. The transformer of claim 1, wherein the undulation structure is molded from epoxy.

8. The transformer of claim 1, wherein the undulation structure is disposed on a plane that is below a plane of the tap connection base so that the tap connection base is raised with respect to the undulation structure.

9. The transformer of claim 1, wherein a conductor lead extends from the tap connection base.

10. The transformer of claim 1, wherein a plurality of tap connection bases are provided and at least some of the bases have generally rectangular shape.

11. The transformer of claim 1, wherein a plurality of tap connection bases are provided and at least some of the bases have generally oval shape.

* * * * *